US008655204B2

(12) United States Patent
Ueno

(10) Patent No.: US 8,655,204 B2
(45) Date of Patent: Feb. 18, 2014

(54) INDUCTION HEATING DEVICE, INDUCTION HEATING FIXING DEVICE, AND IMAGE FORMING APPARATUS

(75) Inventor: Tsuyoshi Ueno, Fukuoka (JP)

(73) Assignee: Ricoh Company, Ltd., Tokyo (JP)

( * ) Notice: Subject to any disclaimer, the term of this patent is extended or adjusted under 35 U.S.C. 154(b) by 120 days.

(21) Appl. No.: 13/231,785

(22) Filed: Sep. 13, 2011

(65) Prior Publication Data

US 2012/0063799 A1 Mar. 15, 2012

(30) Foreign Application Priority Data

Sep. 14, 2010 (JP) ..... 2010-205653

(51) Int. Cl.
*G03G 15/20* (2006.01)

(52) U.S. Cl.
USPC ..... 399/33; 399/67

(58) Field of Classification Search
USPC ..... 399/33, 67; 219/661
See application file for complete search history.

(56) References Cited

U.S. PATENT DOCUMENTS

| | | | | |
|---|---|---|---|---|
| 6,799,002 | B2 | 9/2004 | Birumachi | |
| 2002/0005405 | A1 | 1/2002 | Sato et al. | |
| 2006/0131301 | A1 | 6/2006 | Ohta et al. | |
| 2007/0284357 | A1 | 12/2007 | Takahashi et al. | |
| 2009/0067867 | A1 * | 3/2009 | Yamashita et al. | 399/67 |

FOREIGN PATENT DOCUMENTS

| | | | |
|---|---|---|---|
| JP | 2005190765 | A * | 7/2005 |
| JP | 3902937 | B2 | 1/2007 |
| JP | 2007-305400 | A | 11/2007 |

* cited by examiner

*Primary Examiner* — David Gray
*Assistant Examiner* — Erika J Villaluna
(74) *Attorney, Agent, or Firm* — Dickstein Shapiro LLP

(57) ABSTRACT

An induction heating device includes a resonance circuit including an exciting coil and a resonance capacitor; a switching unit that turns on and off a high-frequency current flowing through the switching unit; a temperature detector that detects a temperature of the heated body; a power amount detector that detects a power amount sent to the exciting coil; a turned-on time setting unit that sets a turned-on time of the switching unit; a timing generation unit that generates a signal indicating a timing when a voltage between both ends of the switching unit is zero; and a timing setting unit that sets a turned-on timing of the switching unit based on the signal generated by the timing generation unit.

7 Claims, 14 Drawing Sheets

INDUCTION HEATING DEVICE, INDUCTION HEATING FIXING DEVICE, AND IMAGE FORMING APPARATUS

CROSS-REFERENCE TO RELATED APPLICATIONS

The present application claims priority under 35 U.S.C §119 to Japanese Patent Application No. 2010-205653 filed Sep. 14, 2010, the entire contents of which are hereby incorporated herein by reference.

BACKGROUND OF THE INVENTION

1. Field of the Invention

The present invention generally relates to an induction heating device that heats a heated body (i.e., a heating target member) by induction heating, an induction heating fixing device including the induction heating device, and an image forming apparatus including the induction heating device.

2. Description of the Related Art

In an image forming apparatus such as a copier and a printing device employing an electrophotographic process, an image is formed by transferring a toner image onto a sheet and then heating the sheet by a fixing roller as a fixing means, the toner image having been formed on a photosensitive body.

Recently, it has become more and more important to address environmental concerns, and accordingly energy conservation in an image forming apparatus has been improving. To improve the energy conservation in the image forming apparatus, it may be necessary to reduce the energy consumption in the fixing device that melts and adheres toner to the sheet.

In response to the demand for reducing the energy consumption, recently, there has been employed an induction heating fixing device 108 as illustrated in FIG. 1, which includes an exciting coil 101, a heating roller 102, a fixing/pressing roller 103, an induction heating driver circuit 104 to control a drive current to the exciting coil 101, and a temperature sensor 105 to detect a temperature of the heating roller 102. Among those elements, it is known that the exciting coil 101, the induction heating driver circuit 104, and the temperature sensor 105 constitute the induction heating device.

The induction heating fixing device 108 heats the heating roller 102 by generating eddy currents in a heat generation layer (electrical conducting layer) of the heating roller 102 by using magnetic flux generated by the exciting coil 101, and transfers the heat of the heating roller 102 to the fixing/pressing roller 103. In the meantime, by feeding a sheet 107 between the heating roller 102 and the fixing/pressing roller 103, the toner 106 mounted on the sheet 107 is melted and adhered to the sheet 107. In this case, the temperature of the heating roller 102 is detected by the temperature sensor 105 provided near the heating roller 102, so that the induction heating driver circuit 104 controls the temperature of the heating roller 102 at a predetermined (desired) temperature.

Recently, the induction heating fixing device 108 having the configuration described above has attracted attention because of having remarkably shorter time period necessary to increase the temperature to the operating temperature and also having higher efficiency so as to contribute to reducing environmental impacts.

FIG. 2 is a schematic circuit diagram including the induction heating driver circuit 104.

As illustrated in FIG. 2, an AC (Alternating-Current) Voltage input from a commercial power source 201 passes through a noise filter circuit 202 including capacitors C1, C2, and C3 and a common-mode choke coil L1 and is full-wave rectified by a diode bridge DB1.

The full-wave rectified AC voltage is converted (smoothed) into a direct current (DC) by an LC filter circuit 203 including capacitors C4 and C5 and a choke coil L2 and is input to one end of a resonance capacitor Cres. The other end of the resonance capacitor Cres is connected to the collector of a switching device Q1 made of an IGBT (Insulated Gate Bipolar Transistor) or the like. In this case, the emitter of the switching device Q1 is connected to ground (GND).

The ends of the resonance capacitor Cres are connected to corresponding ends of the exciting coil 101 via two wires and an external connector CN1, so that the exciting coil 101 and the resonance capacitor Cres constitute an LC parallel resonance circuit.

A drive circuit 206 of a control circuit 204 outputs a drive signal to the base of the switching device Q1. By turning on and off the switching device Q1 by the drive signal from the control circuit 204, a high-frequency current flows to the exciting coil 101. As a result, the magnetic flux is applied to the heating roller 102 and the eddy currents are generated in the surface of the heating roller 102 to generate heat in the heating roller 102.

As illustrated in FIG. 2, the control circuit 204 includes an input power detecting section 205, a control section 207, and the drive circuit 206. The input power detecting section 205 detects input AC power based on detection signals from an input current detecting circuit 205*a* and an input voltage detecting circuit 205*b*. The control section 207 calculates an appropriate pulse width (length) based on the output from the input power detecting section 205 and a temperature detecting signal from the temperature sensor 105. The drive circuit 206 drives the switching device Q1 based on a signal from the control section 207.

The LC parallel resonance circuit including the exciting coil 101 and the resonance capacitor Cres, the switching device Q1, and a diode D1 of the switching device Q1 constitute a voltage resonance (type) inverter. The operations of the voltage resonance (type) inverter are described with reference to FIGS. 3 and 4.

FIG. 3 schematically illustrates transitions of the on/off states of the switching device Q1 and relationships between the on/off states and the corresponding currents flowing through any of the exciting coil 101, the resonance capacitor Cres, the switching device Q1, and the diode D1. On the other hand, FIG. 4 schematically illustrates waveforms of the drive voltage VG of the switching device Q1, a voltage between the collector and the emitter Vce, and a high-frequency current IL flowing through the exciting coil 101. In FIG. 3, the parts drawn using the dashed dotted lines indicate the parts where the high-frequency current IL hardly flows because of relatively higher impedance.

As schematically illustrated in FIG. 3, a feature of the voltage resonance (type) inverter is that when the switching device Q1 is turned on and turned off, the voltage between the collector and the emitter Vce (i.e., the voltage between both ends) of the switching device Q1 is 0 V. In other words, while the voltage between the collector and the emitter Vce is 0 V, the switching device Q1 is turned on and turned off. Because of this feature, it may become possible to reduce the loss in the switching device Q1.

As schematically illustrated in FIGS. 3 and 4, there are the following four voltage resonance states (I) to (IV) generated by turning on and off the switching device Q1.

State (I): When the drive voltage VG is set to a high level so that the switching device Q1 is turned on, the commercial voltage having been transformed into DC voltage is applied between ground and one end of the exciting coil 101, the one end of the exciting coil 101 being opposite to the other end connected to the switching device Q1. As a result, the high-frequency current IL starts flowing through the exciting coil 101. Further, a desired turned-on time Ton (see FIG. 4) is set so as to obtain (apply) a desired power level. During the turned-on time Ton, the high-frequency current IL linearly increases.

State (II): After the desired turned-on time Ton has elapsed, the drive voltage VG is set to a low level so that the switching device Q1 is turned off. Then, a counter electromotive voltage is generated in the exciting coil 101, and the high-frequency current IL flows to start charging the resonance capacitor Cres. This charging process continues until the energy in the exciting coil 101 becomes zero (runs out). At that timing, the voltage Vice between the collector and the emitter of the switching device Q1 has its peak value.

State (III): Since the switching device Q1 is still turned off, the energy charged in the resonance capacitor Cres starts being discharged to the exciting coil 101. This discharge continues until the energy in the resonance capacitor Cres becomes zero (i.e., until the voltage Vce between the collector and the emitter of the switching device Q1 becomes zero). The operations in the states (II) and (III) correspond to resonance operations having the characteristics determined by the exciting coil 101 and the resonance capacitor Cres. More specifically, a turned-off time Toff is determined based on the inductance of the exciting coil 101 and the capacitance of the resonance capacitor Cres. During this state (III), the high-frequency current IL decreases in a sine waveform.

State (IV): When the discharge from the resonance capacitor Cres is finished, the diode D1 is turned on due to the counter electromotive voltage generated in the exciting coil 101. As a result, the high-frequency current IL flows from the diode D1 to the exciting coil 101. Therefore, during this state (IV), the high-frequency current IL linearly increases.

As described above, in the voltage resonance (type) inverter, the switching device Q1 is turned on while the voltage Vce between the collector and the emitter of the switching device Q1 is zero (zero voltage switching). Further, in the voltage resonance (type) inverter, generally, the frequency control is performed so as to obtain a desired temperature and a desired power level by controlling a harmonic current by controlling the length of the turned-on time Ton while the turned-off time Toff is set to be constant.

However, the inductance of the exciting coil 101 is determined based on a combination of the exciting coil 101 and the heating roller 102. More specifically, the inductance of the exciting coil 101 may vary depending on the temperature conditions of the exciting coil 101 and the heating roller 102. Because of this feature, when the inductance value of the exciting coil 101 changes by the temperature increase of the exciting coil 101 and the heating roller 102 due to the induction heating, the resonance frequency of the LC parallel resonance circuit including the exciting coil 101 and the resonance capacitor Cres varies (fluctuates). In FIG. 4, the part labeled "turned-on timing" denotes a range where the turned-on timing (i.e., end of the turned-off time Toff) varies due to the change (fluctuation) of the resonance frequency of the LC parallel resonance circuit.

Because of this feature, for example, as illustrated in FIG. 5, when the setting of the turned off timing (turned-on timing) is delayed, the switching device Q1 may be turned on or turned off while the voltage Vice between the collector and the emitter of the switching device Q1 is not zero volts. As a result, the energy charged in the resonance capacitor Cres may be discharged in, for example, a spike current to ground (GND) via the switching device Q1. Namely, the energy charged in the resonance capacitor Cres may not be converted into the energy to heat the heating roller 102 but may be lost in the switching device Q1 or may cause a temperature increase of the switching device Q1 or damage to the switching device Q1.

To overcome the problems, Japanese Patent No. 3902937 proposes a method to prevent an over-current when the switching device is turned on by calculating and setting an appropriate time period of the turned-on time and an appropriate time period of the turned-off time based on the detected value of the input voltage of the voltage resonance (type) inverter and the detected value of the temperature of the heat roller.

However, to respond to a recent strong demand for increasing the heating speed of the heating roller to reduce the heating time by the induction heating and improving the efficiency, the inductance may vary faster than ever. Therefore, when it is desired to control both the time period of the turned-on time and the time period of the turned-off time by performing a conventional calculation process and a conventional pulse width (length) setting process, the series of processes may not catch up (follow) the faster change of the inductance and be delayed. As a result, the energy loss in the switching device and the likelihood of damaging the switching device may be increased. Further, when such a fast calculation is desired to be performed, the cost of the control circuit may be increased.

SUMMARY OF THE INVENTION

The present invention is made to resolve at least one of the problems described above, and may provide a stable induction heating operation using the voltage resonance (type) inverter and fast power control while preventing the energy loss in the switching device and damage to the switching device even when the resonance frequency varies during the operation.

According to an aspect of the present invention, an induction heating device includes a resonance circuit including an exciting coil and a resonance capacitor, the exciting coil applying magnetic flux to a heated body, the resonance capacitor being connected to the exciting coil in parallel; a switching unit that turns on and off a high-frequency current flowing through the switching unit; a temperature detector that detects a temperature of the heated body; a power amount detector that detects a power amount at the exciting coil; a turned-on time setting unit that sets a turned-on time of the switching unit; a timing generation unit that generates a signal indicating a timing when a voltage between both ends of the switching unit is zero; and a timing setting unit that sets a turned-on timing of the switching unit based on the signal generated by the timing generation unit.

BRIEF DESCRIPTION OF THE DRAWINGS

Other objects, features, and advantages of the present invention will become more apparent from the following description when read in conjunction with the accompanying drawings, in which.

DETAILED DESCRIPTION OF THE PREFERRED EMBODIMENTS

In the following, embodiments of the present invention are described with reference to accompanying drawings.

First Embodiment

Figure 6:
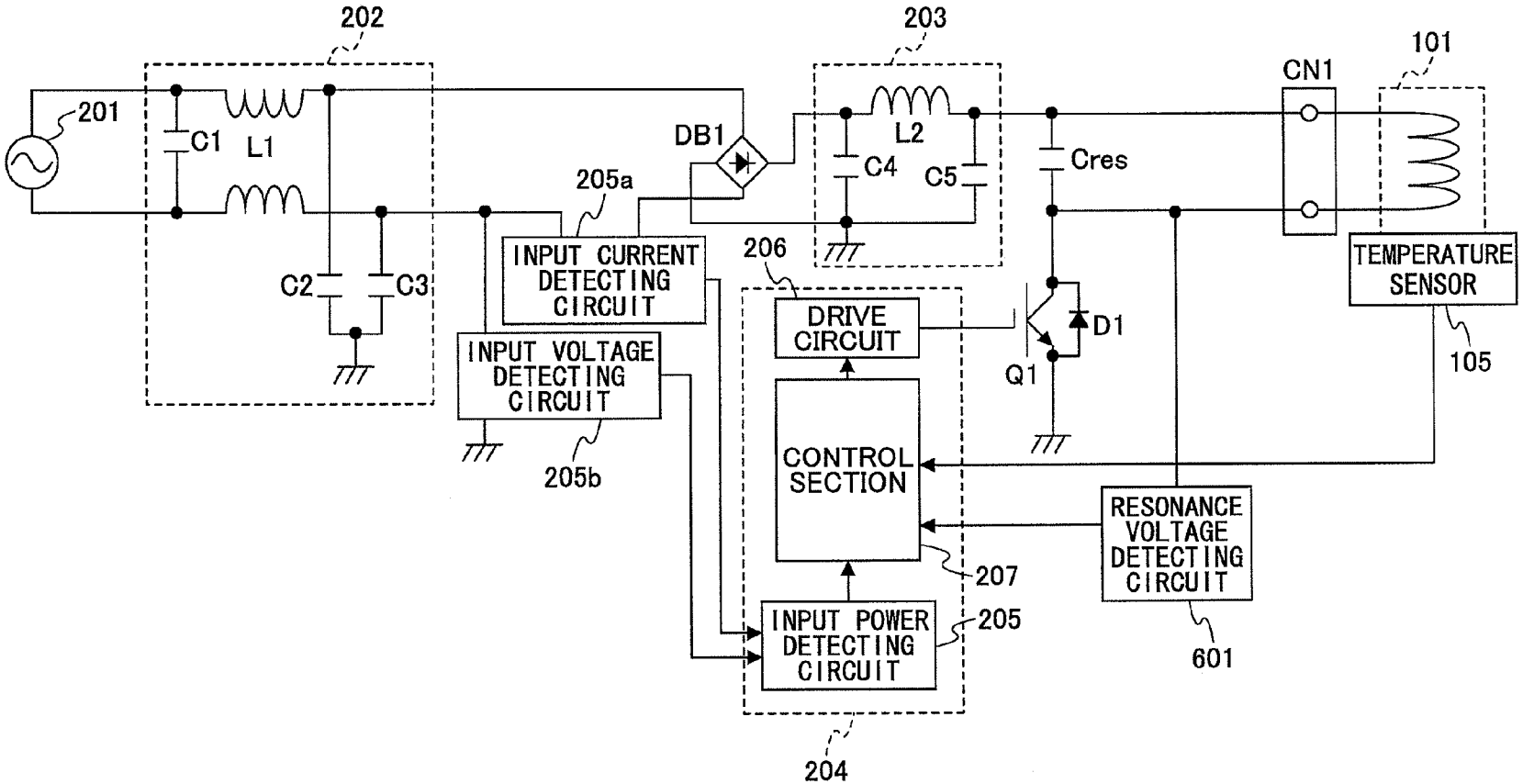
FIG. 6 is a schematic circuit block diagram of an induction heating device according to a first embodiment of the present invention.

FIG. 6 illustrates a configuration of an induction heating device according to a first embodiment of the present invention. In FIG. 6, the same reference numerals are used to describe the elements same as or equivalent to those in FIG. 2, and the descriptions thereof may be omitted. Similar to the induction heating device of FIG. 2, the induction heating device of FIG. 6 may also be used in an induction heating fixing device of an image forming apparatus.

Figure 1:
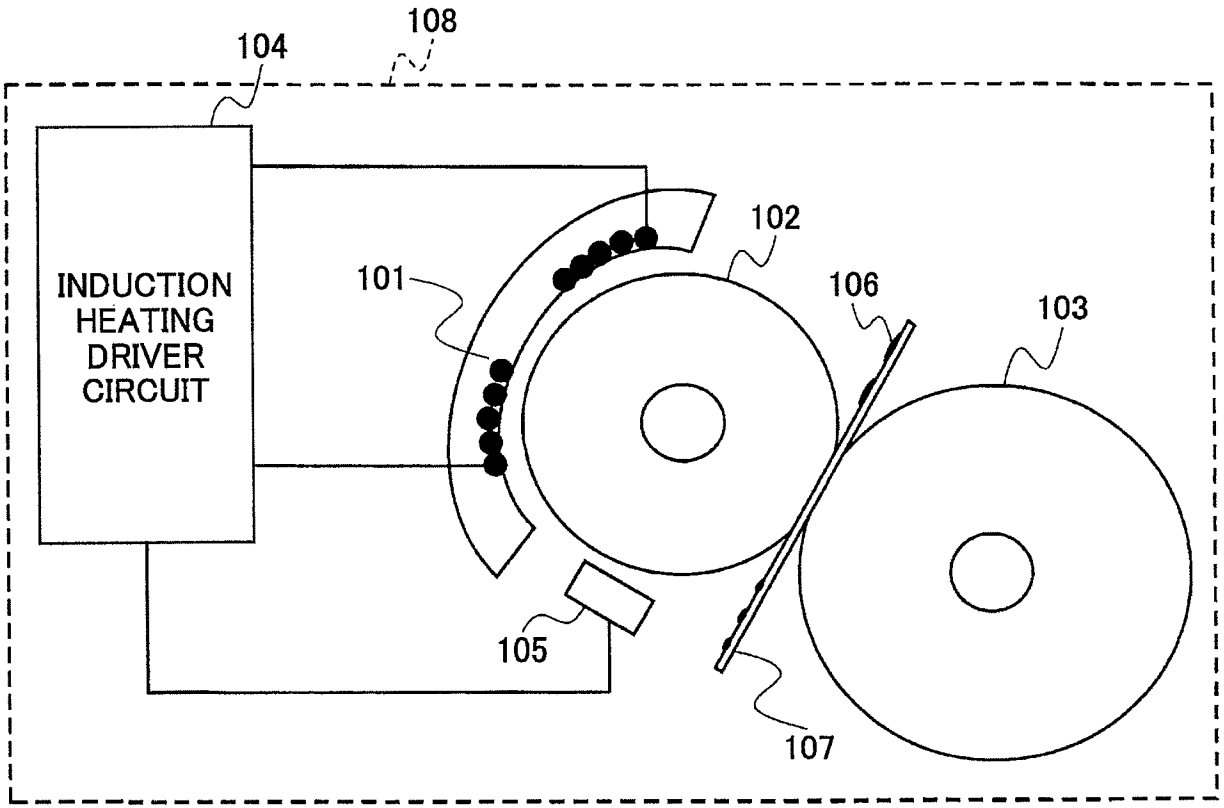
FIG. 1 is a drawing illustrating an induction heating fixing device of the related art.
Figure 2:
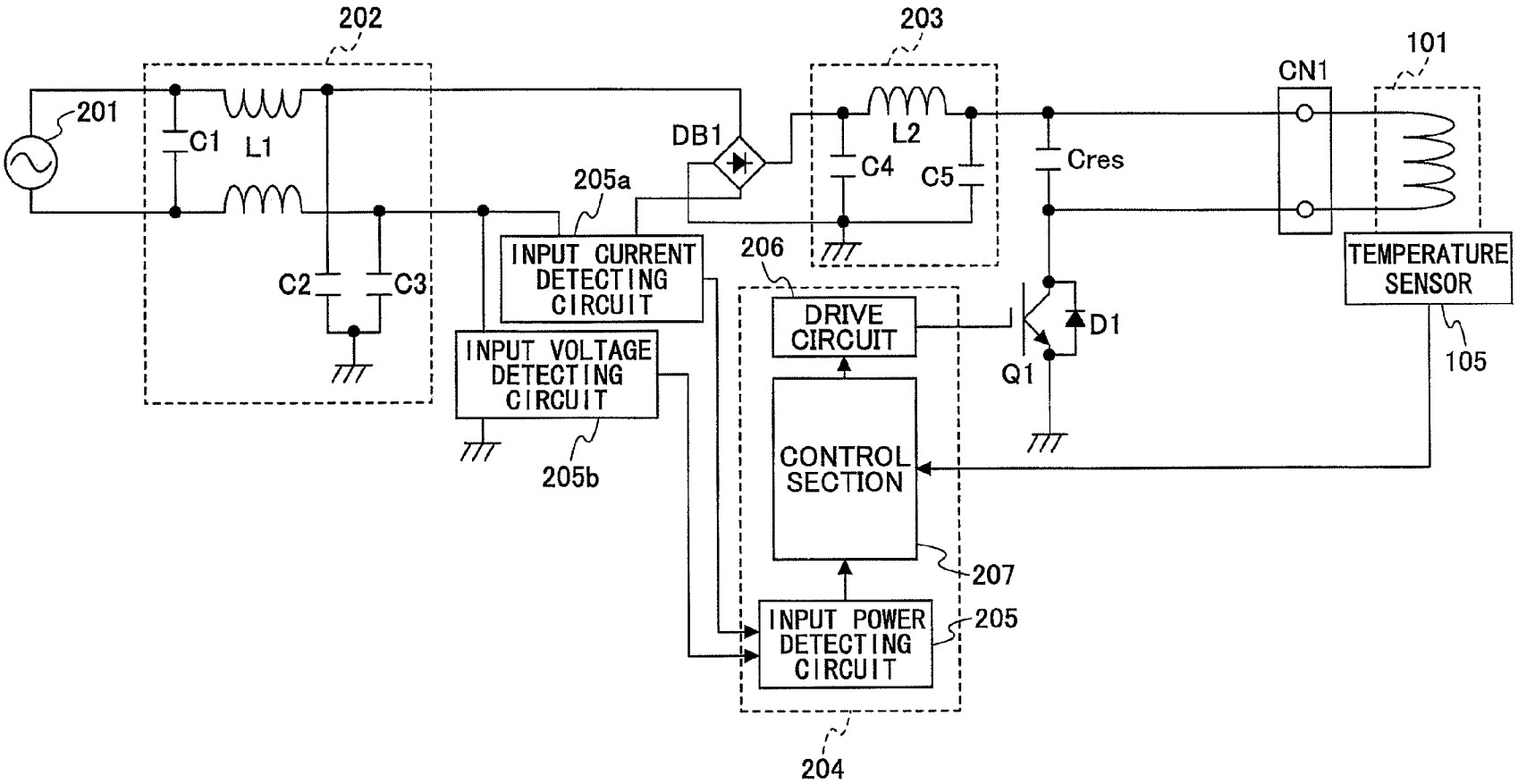
FIG. 2 is a schematic circuit block diagram of an induction heating device in FIG. 1.
Figure 3:
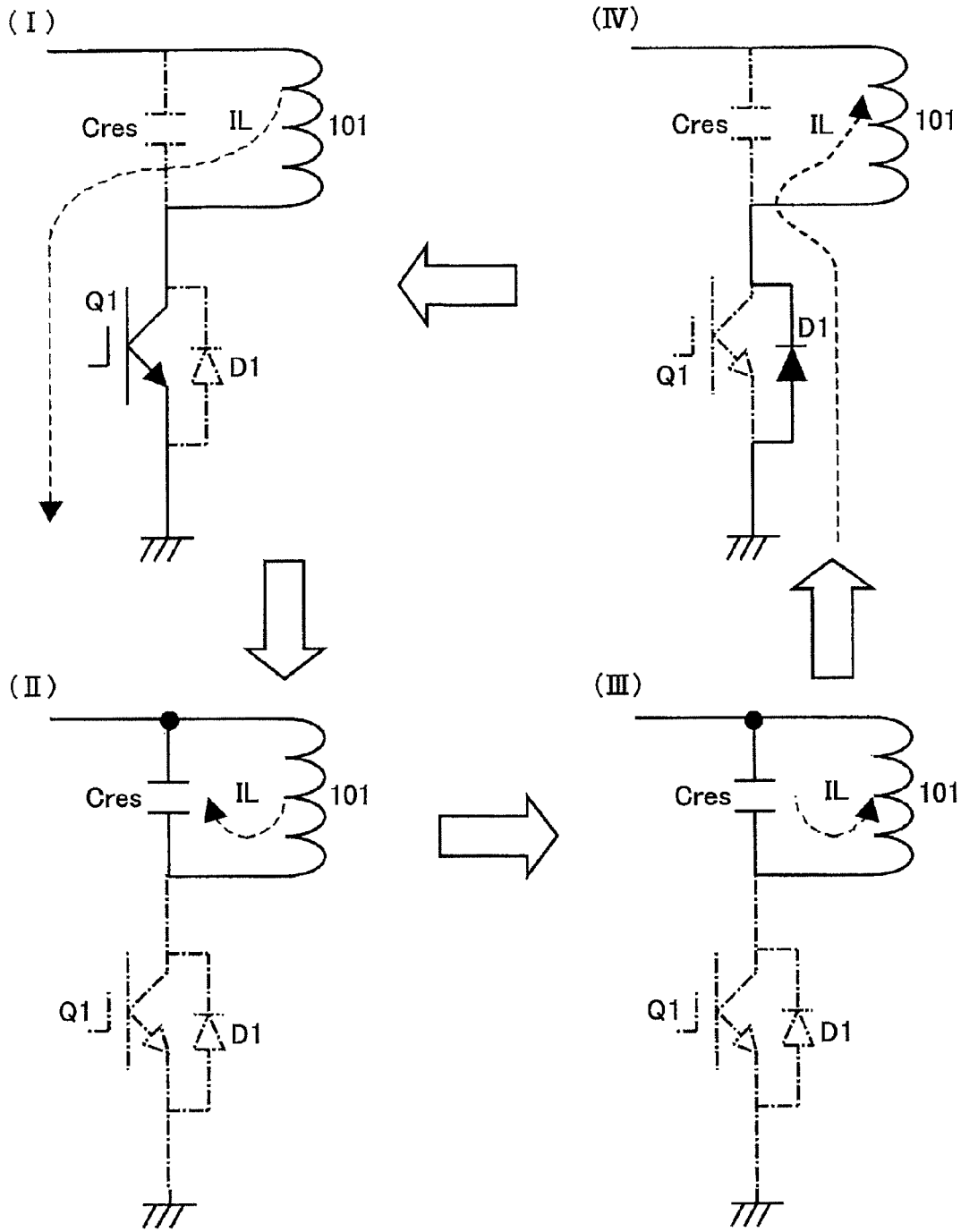
FIG. 3 is a drawing illustrating states when a switching device in FIG. 2 is turned on and off.
Figure 4:
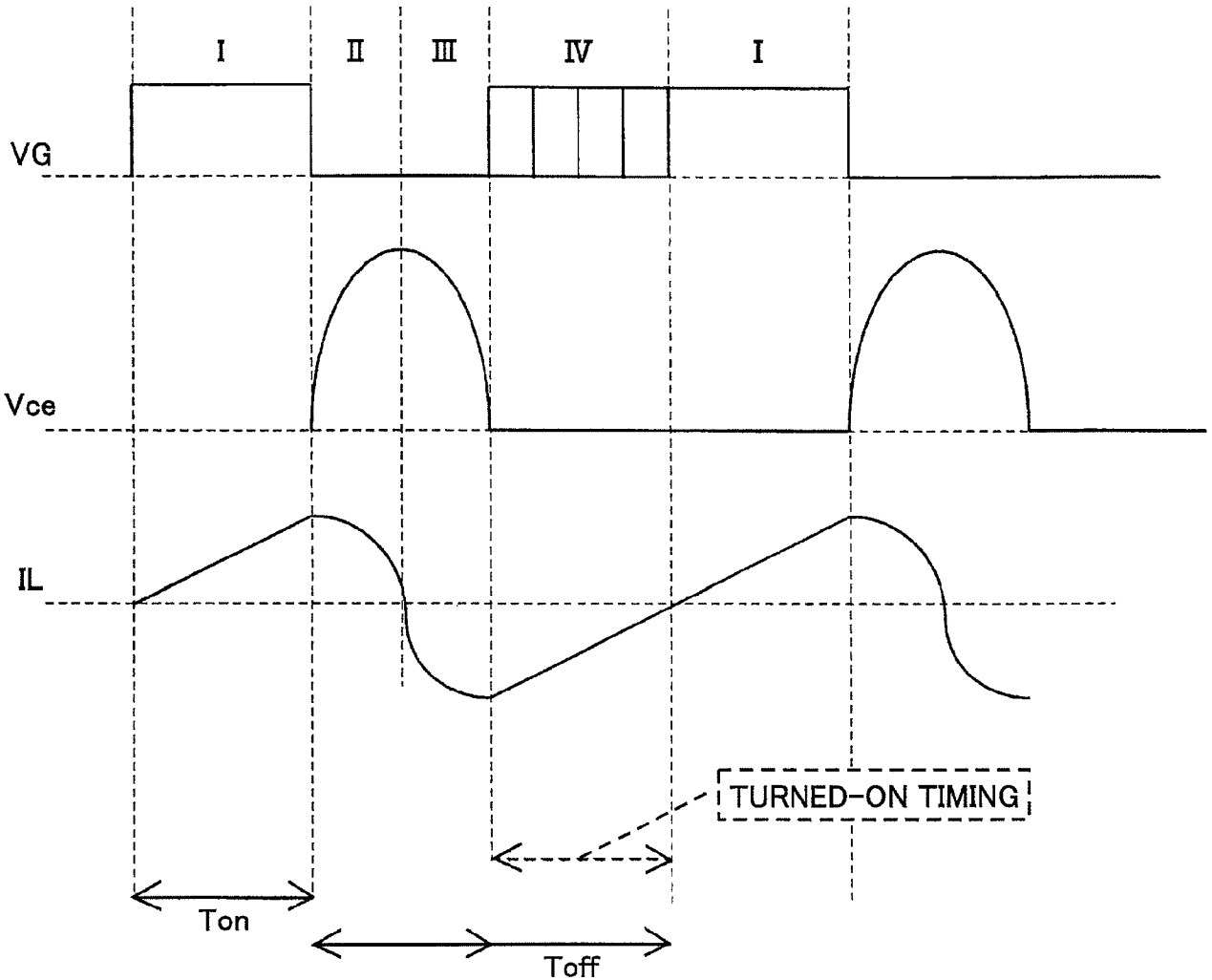
FIG. 4 is a graph illustrating waveforms of a drive voltage of the switching device, a voltage between the collector and the emitter of the switching device, and a current flowing through an exciting coil.
Figure 5:
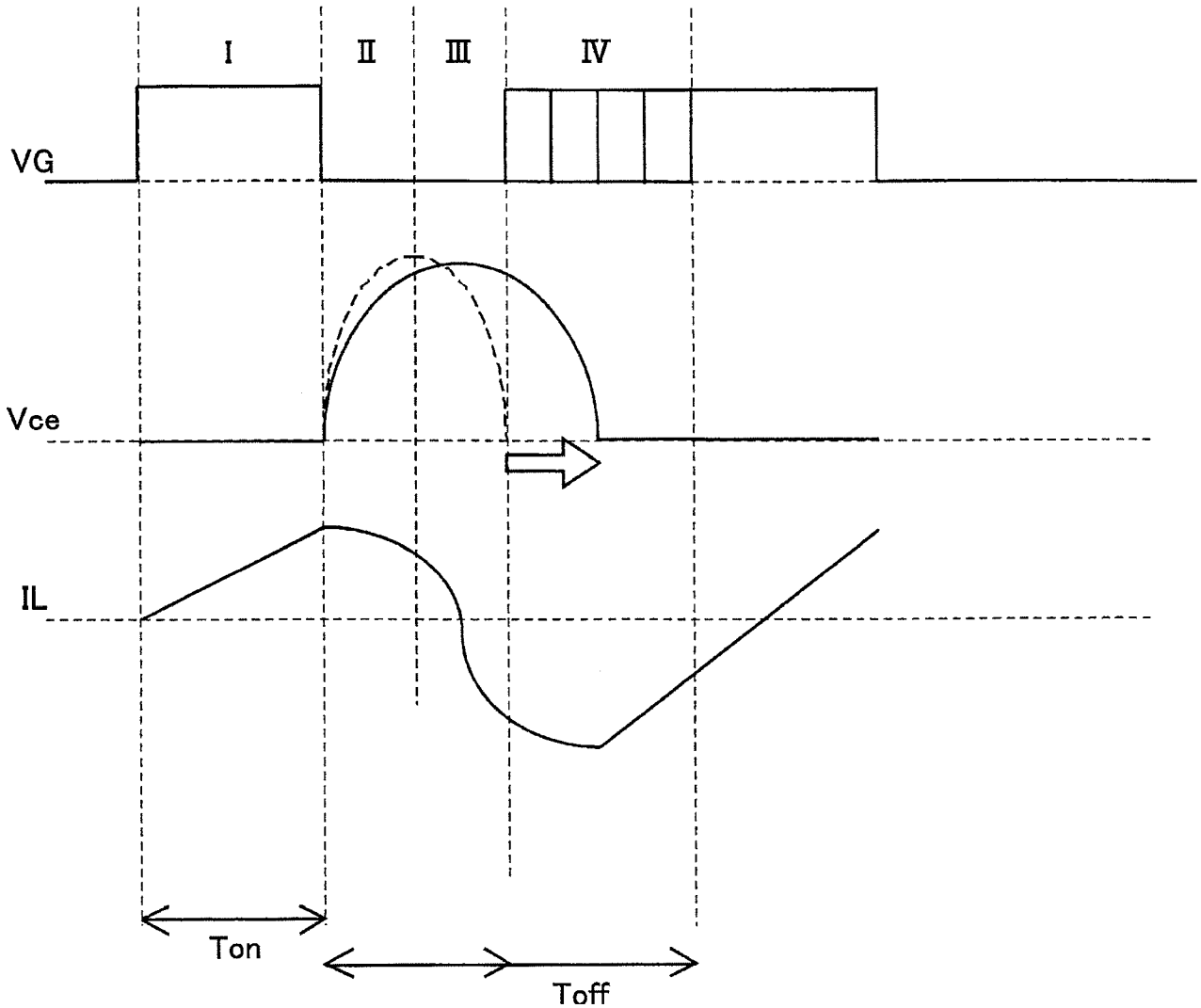
FIG. 5 is a graph illustrating a case where a turned-on timing is delayed.

The induction heating device according to the first embodiment of the present invention differs from the induction heating device of the related art in FIG. 2 in that, for example, the induction heating device according to the first embodiment of the present invention further includes a resonance voltage detecting circuit 601. Namely, besides the resonance voltage detecting circuit 601, the configuration of the induction heating device according to the first embodiment of the present invention is similar to that of the induction heating device of the related art in FIG. 2.

Figure 7:
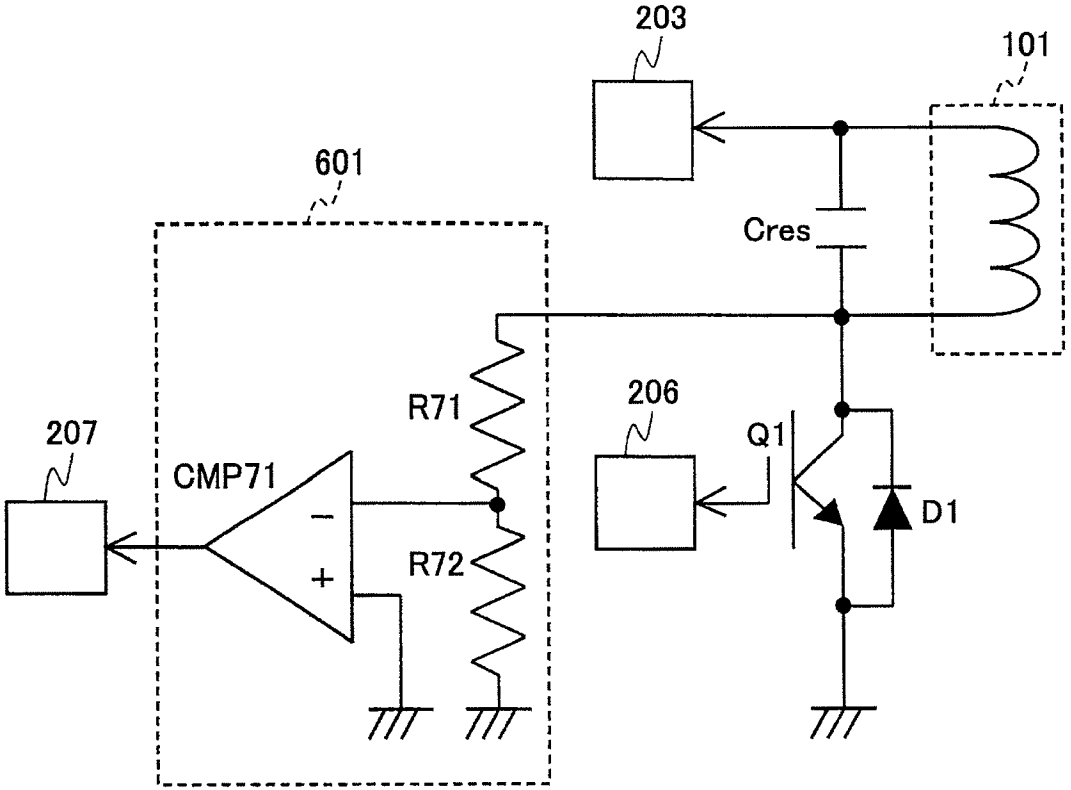
FIG. 7 is a drawing illustrating a resonance voltage detecting circuit in FIG. 6.

FIG. 7 illustrates a circuit configuration of the resonance voltage detecting circuit 601.

As illustrated in FIG. 7, the resonance voltage detecting circuit 601 includes resistors R71 and R72 connected in series, and a comparator CMP71. One end of the resistor R71 is connected to the junction point of the exciting coil 101, the resonance capacitor Cres, and the switching device Q1. One end of the resistor R72 is connected to ground (GND). One input terminal (inverting input terminal) of the comparator CMP71 is connected to the junction point of the resistor R71 and the resistor R72. The other input terminal (non-inverting input terminal) of the comparator CMP71 is connected to ground (GND). The output of the comparator CMP71 is connected (input) to the control section 207 of the control circuit 204.

Namely, in the resonance voltage detecting circuit 601, the resonance voltage of the LC parallel resonance circuit including the exciting coil 101 and the resonance capacitor Cres is divided by using the resistors R71 and R72, and the divided voltage is input to the inverting input terminal of the comparator CMP71.

Figure 8:
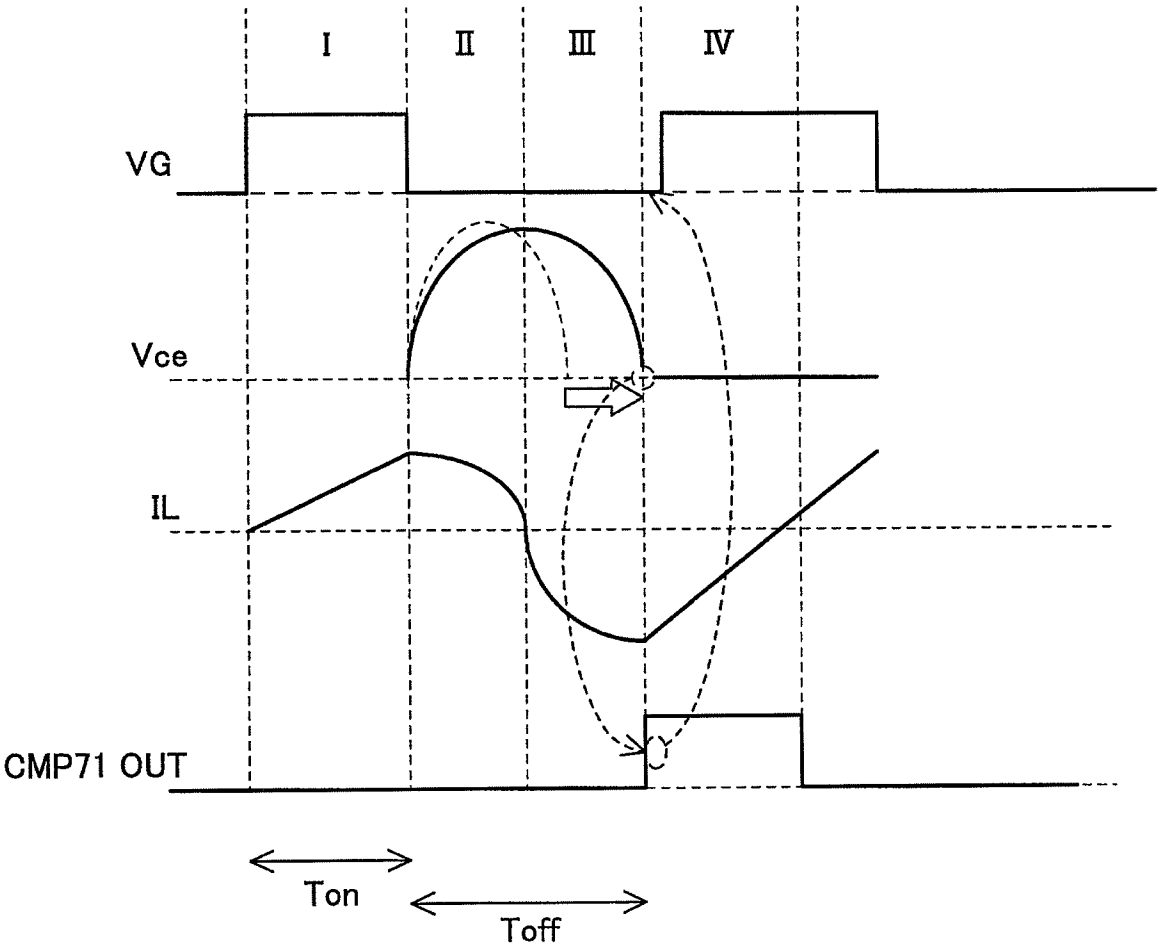
FIG. 8 is a graph illustrating waveforms of the drive voltage of the switching device, the voltage between the collector and the emitter of the switching device, the current flowing through the exciting coil, and an output of the resonance voltage detecting circuit in FIG. 6.

FIG. 8 is a graph illustrating the waveforms of the drive voltage of the switching device Q1, the voltage Vice between the collector and the emitter of the switching device Q1, the high-frequency current flowing through the exciting coil 101, and the output voltage of the comparator CMP71 of the resonance voltage detecting circuit 601.

As described above, the resonance frequency of the LC parallel resonance circuit including the exciting coil 101 and the resonance capacitor Cres varies (fluctuates) due to the temperature increase of the heating roller 102 and the exciting coil 101. To respond to the fluctuation of the resonance frequency, according to this embodiment of the present invention, attention is paid to the voltage Vce between both ends of the switching device Q1. Specifically, at the timing when Vce is zero (Vce=0), the comparator CMP71 is configured to output a turned-on timing control signal to the control section 207. To that end, the comparator CMP71 is configured to compare the divided voltage of the resonance voltage with ground (GND) level, and when determining that the divided voltage of the resonance voltage is equal to ground (GND) level, the comparator CMP71 is configured to output the turned-on timing control signal.

The pulse width of the pulse output from the drive circuit 206 under the control of the control section 207 is determined by using a digital control circuit such as a microcomputer and an FPGA (Field Programmable Gate Array) as the control section 207. Specifically, the pulse width (length) of the turned-on time Ton (hereinafter may be simplified as "On-width") is controlled based on the calculation result of the input power detecting section 205 and the calculation result of the temperature sensor 105. On the other hand, the pulse width (length) of the turned-off time Toff (hereinafter may be simplified as "Off-width") is controlled based on the turned-on timing control signal.

By doing in this way, it may become possible to promptly respond to the change (fluctuation) of the resonance frequency of the LC parallel resonance circuit including the exciting coil 101 and the resonance capacitor Cres. Further, as schematically illustrated in FIG. 8, while the voltage Vice between both ends of the switching device Q1 is zero volts, the drive voltage VG may be set to a high level so that the switching device Q1 is turned on. Because of this feature, it may become possible to control the voltage resonance (type) inverter at desired power and temperature while preventing the increase of the energy loss in the switching device Q1 and the damage to the switching device Q1 even when the resonance frequency varies during the operation.

As an example, in a case where a microcomputer is used as the control section 207, a PWM (Pulse Width Modulation) control unit may be used to output a signal (data) to the drive circuit 206, a timer unit may be used to control the On-width, a value of the comparison register may be updated based on the measurement value of the input power and the temperature, and an interruption process based on the turned-on timing control signal may be used to control the Off-width. Further, after the switching device Q1 is turned off, an interruption wait time in the resonance operation may occur. By measuring the input power and the temperature and updating the registers in the timer unit in the interruption wait time, the update may be performed (completed) within each pulse (cycle), and a faster response may be achieved.

As described above, according to this embodiment of the present invention, by changing the level of the drive voltage VG to a high level based on the turned-on timing control signal generated by detecting the timing when the voltage Vice between both ends of the switching device Q1 is zero volts, the switching device Q1 may be turned on while the voltage Vice between both ends of the switching device Q1 is zero volts. Therefore, it may become possible to promptly respond to the change of the resonance frequency of the LC parallel resonance circuit including the exciting coil 101 and the resonance capacitor Cres, and control the voltage resonance (type) inverter at desired power and temperature while preventing the increase of the energy loss in the switching device Q1 and the damage to the switching device Q1.

Second Embodiment

Figure 9:
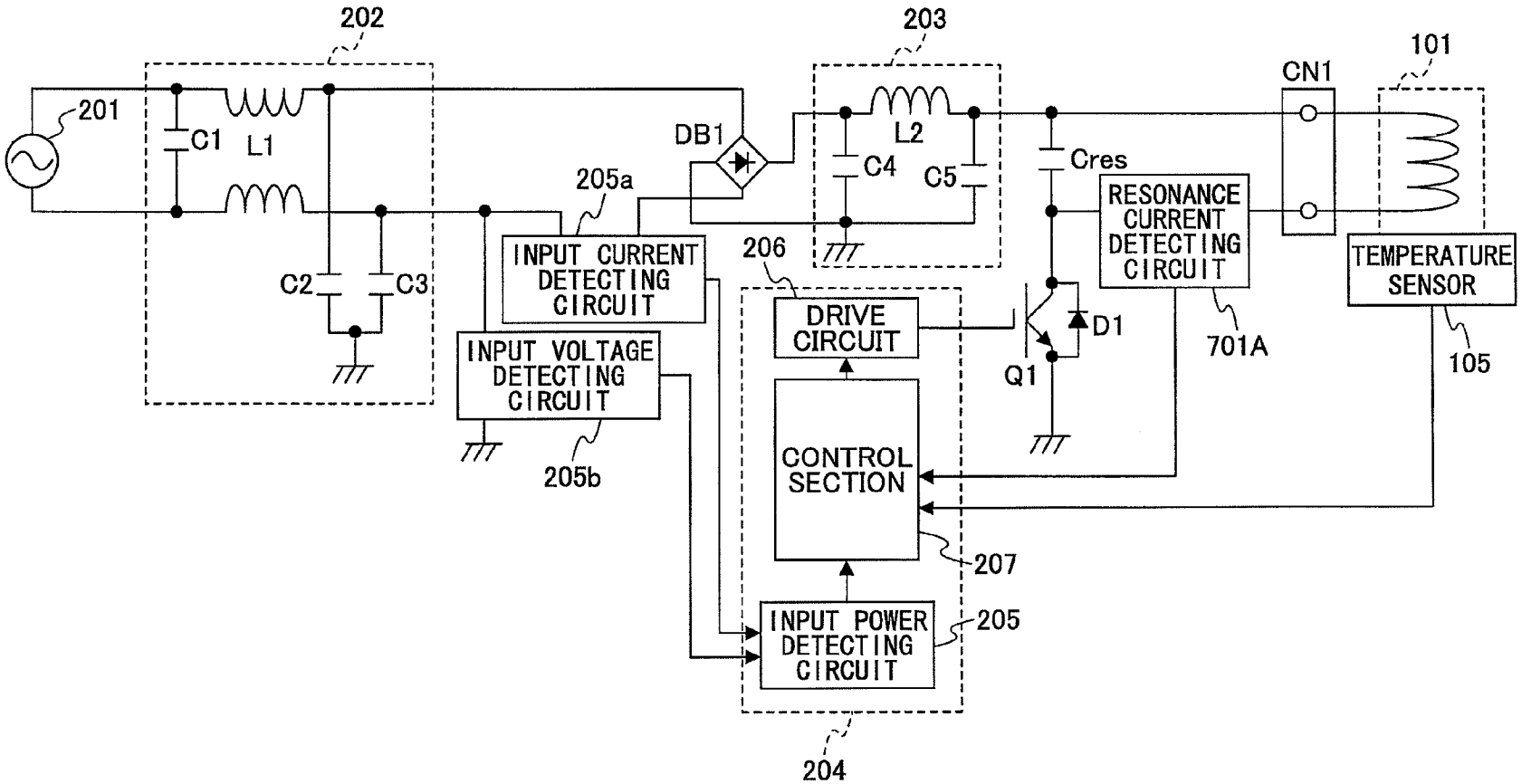
FIG. 9 is a schematic circuit block diagram of an induction heating device according to a second embodiment of the present invention.

FIG. 9 illustrates a configuration of an induction heating device according to a second embodiment of the present invention. In FIG. 9, the same reference numerals are used to describe the elements same as or equivalent to those in FIG. 6, and the descriptions thereof may be omitted. Similar to the induction heating device of FIG. 6, the induction heating device of FIG. 9 may also be used in an induction heating fixing device of an image forming apparatus.

The induction heating device according to the second embodiment of the present invention differs from the induction heating device of the related art in FIG. 2 in that, for example, the induction heating device according to the second embodiment of the present invention further include a resonance current detecting circuit 701A. Namely, besides the resonance current detecting circuit 701A, the configuration of the induction heating device according to the second embodiment of the present invention is similar to that of the induction heating device of the related art in FIG. 2.

Figure 10:
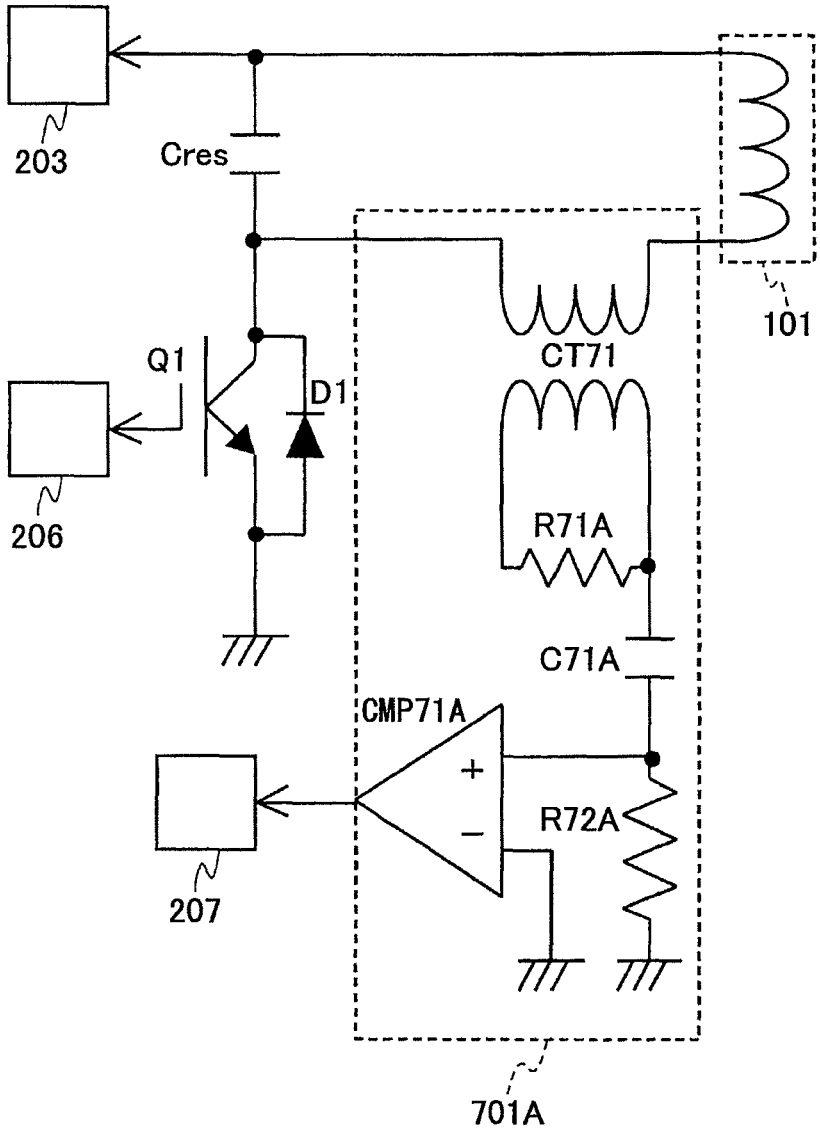
FIG. 10 is a drawing illustrating a resonance current detecting circuit in FIG. 9.
Figure 11:
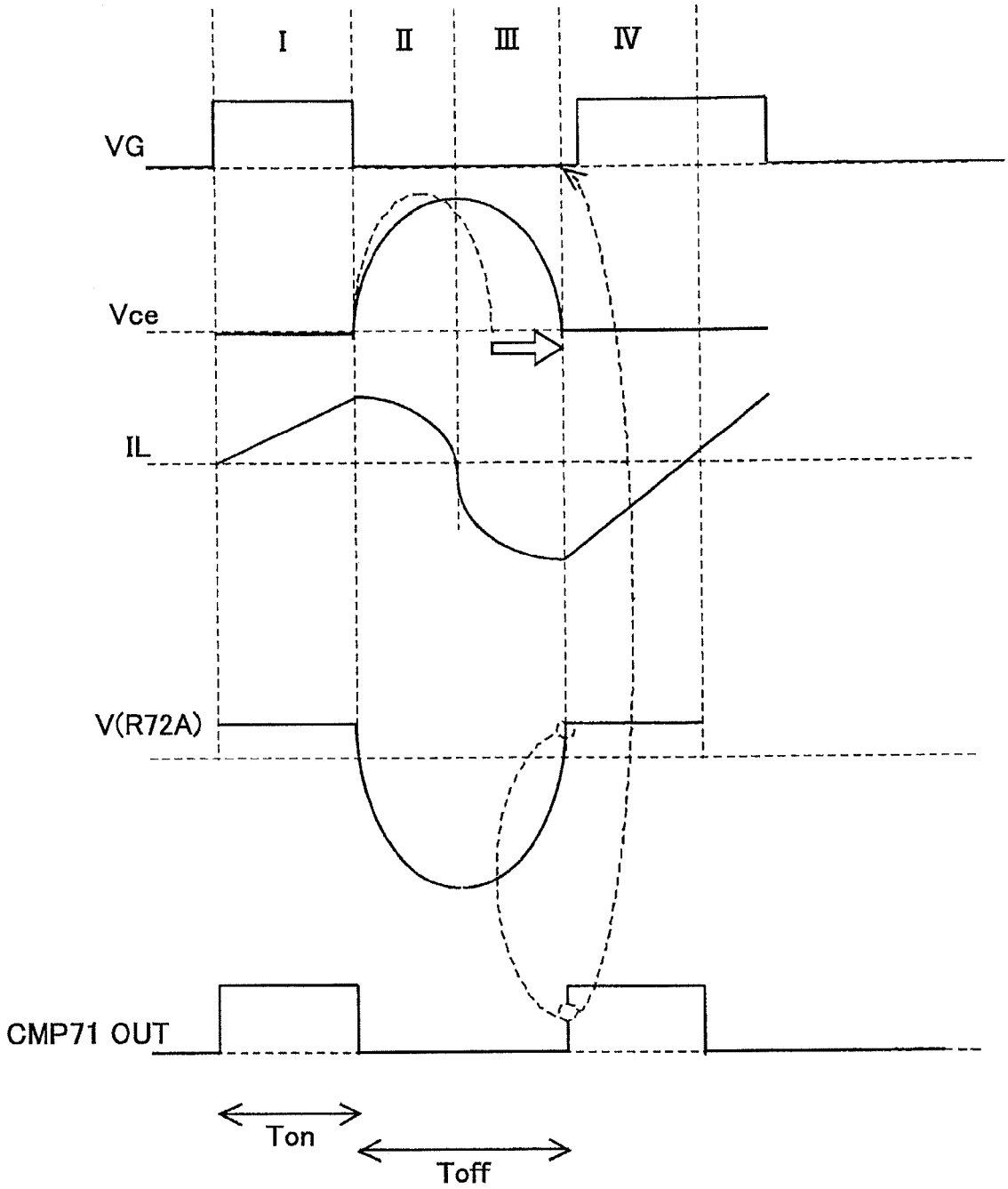
FIG. 11 is a graph illustrating waveforms of the drive voltage of the switching device, the voltage between the collector and the emitter of the switching device, the current flowing through the exciting coil, and an output of the resonance current detecting circuit in FIG. 9.

FIG. 10 illustrates a circuit configuration of the resonance current detecting circuit 701A. FIG. 11 schematically illustrates the waveforms of the drive voltage of the switching device Q1, the voltage Vice between the collector and the emitter of the switching device Q1, the high-frequency current flowing through the exciting coil 101, and the output voltage of the resonance current detecting circuit 701A.

As illustrated in FIG. 10, the resonance current detecting circuit 701A includes a current transformer CT71, a resistor R71A, a capacitor C71A, a resistor R71B, and a comparator CMP71A. The current transformer CT71 includes a primary coil and a secondary coil. The primary coil is connected between the exciting coil 101 and the resonance capacitor Cres of the LC parallel resonance circuit. The secondary coil is connected with the resistor R71A in parallel. One end of the resistor R71A is connected to one end of the capacitor C71A. The other end of the capacitor C71A is connected to one end of the resistor R72A. The other end of the resistor R72A is connected to ground (GND). One input terminal (non-inverting input terminal) of the comparator CMP71A is connected to the junction point of the capacitor C71A and the resistor R71A. The other input terminal (inverting input terminal) of the comparator CMP71A is connected to ground (GND). The output of the comparator CMP71A is connected (input) to the control section 207 of the control circuit 204.

In the resonance current detecting circuit 701A, the resonance current is measured by performing the current-voltage conversion. Namely, the voltage V(R72A) illustrated in FIG. 11 is obtained by the differentiating circuit including the capacitor C71A and the resistor R72A. The voltage V(R72A) is input to the comparator CMP71A. The comparator CMP71A generates its output signal (i.e., the turned-on timing control signal) at the timing when a state where the voltage V(R72A) gradually increases transitions to a state where the voltage V(R72A) does not change and is constant (in other words, at the timing when a state where the high-frequency current IL flowing through the exciting coil 101 decreases in a sine waveform transitions to a state where the high-frequency current IL starts linearly increasing). As illustrated in FIG. 11, the timing described above corresponds to the timing when the voltage Vce between the collector and the emitter of the switching device Q1 becomes zero volts. Namely, substantially (as a matter of fact), the comparator CMP71A detects the timing when the voltage Vce between the collector and the emitter of the switching device Q1 becomes zero volts.

As described above, according to this embodiment of the present invention, by detecting the timing when the state where the high-frequency current IL flowing through the exciting coil 101 decreases in a sine waveform transitions to the state where the high-frequency current IL starts linearly increasing, it may become possible to indirectly or equivalently detect the timing when the voltage Vce between the collector and the emitter of the switching device Q1 becomes zero volts and generate the turned-on timing control signal at that timing. Further, by turning on the switching device Q1 while the voltage Vice between the collector and the emitter of the switching device Q1 is zero volts by changing the level of the drive voltage VG to a high level based on the turned-on timing control signal, it may become possible to promptly respond to the change of the resonance frequency of the LC parallel resonance circuit including the exciting coil 101 and the resonance capacitor Cres, and control the voltage resonance (type) inverter at desired power and temperature while preventing the increase of the energy loss in the switching device Q1 and the damage to the switching device Q1.

Third Embodiment

Figure 12:
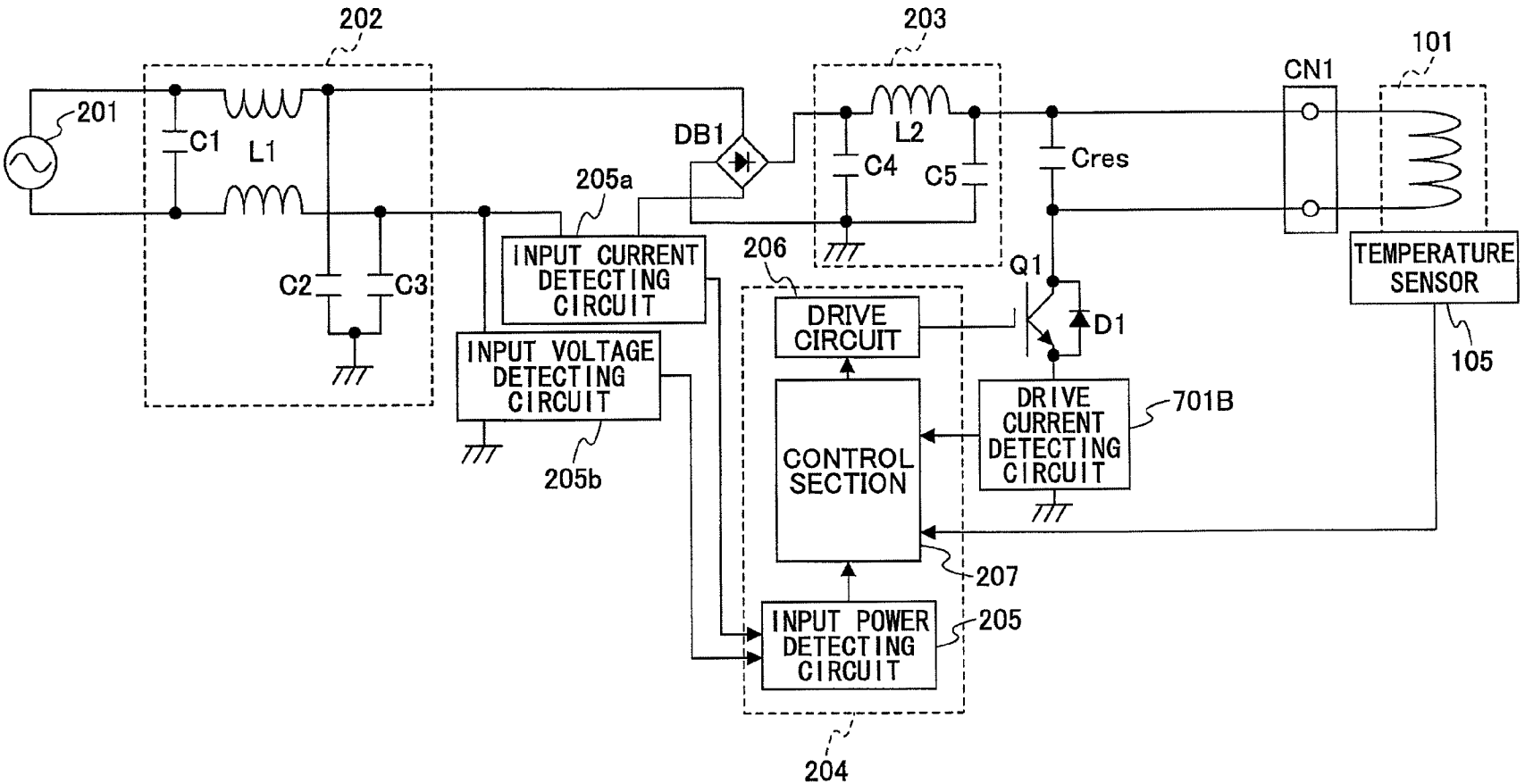
FIG. 12 is a schematic circuit block diagram of an induction heating device according to a third embodiment of the present invention.

FIG. 12 illustrates a configuration of an induction heating device according to a third embodiment of the present invention. In FIG. 12, the same reference numerals are used to describe the elements same as or equivalent to those in FIG. 6, and the descriptions thereof may be omitted. Similar to the induction heating device of FIG. 6, the induction heating device of FIG. 12 may also be used in an induction heating fixing device of an image forming apparatus.

The induction heating device according to the third embodiment of the present invention differs from the induction heating device of the related art in FIG. 2 in that, for example, the induction heating device according to the third embodiment of the present invention further includes a drive current detecting circuit 701B. Namely, besides the drive current detecting circuit 701B, the configuration of the induction heating device according to the third embodiment of the present invention is similar to that of the induction heating device of the related art in FIG. 2.

Figure 13:
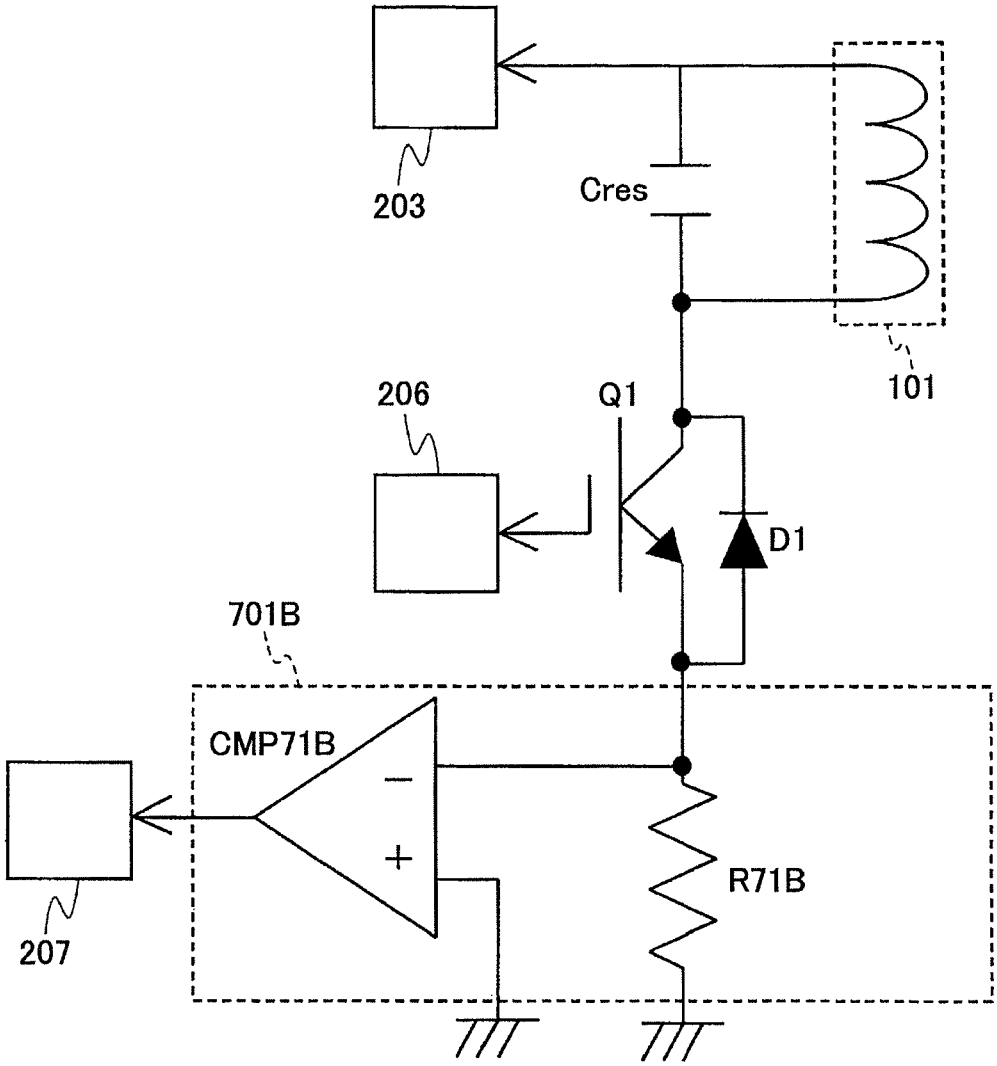
FIG. 13 is a drawing illustrating a drive current detecting circuit in FIG. 12.
Figure 14:
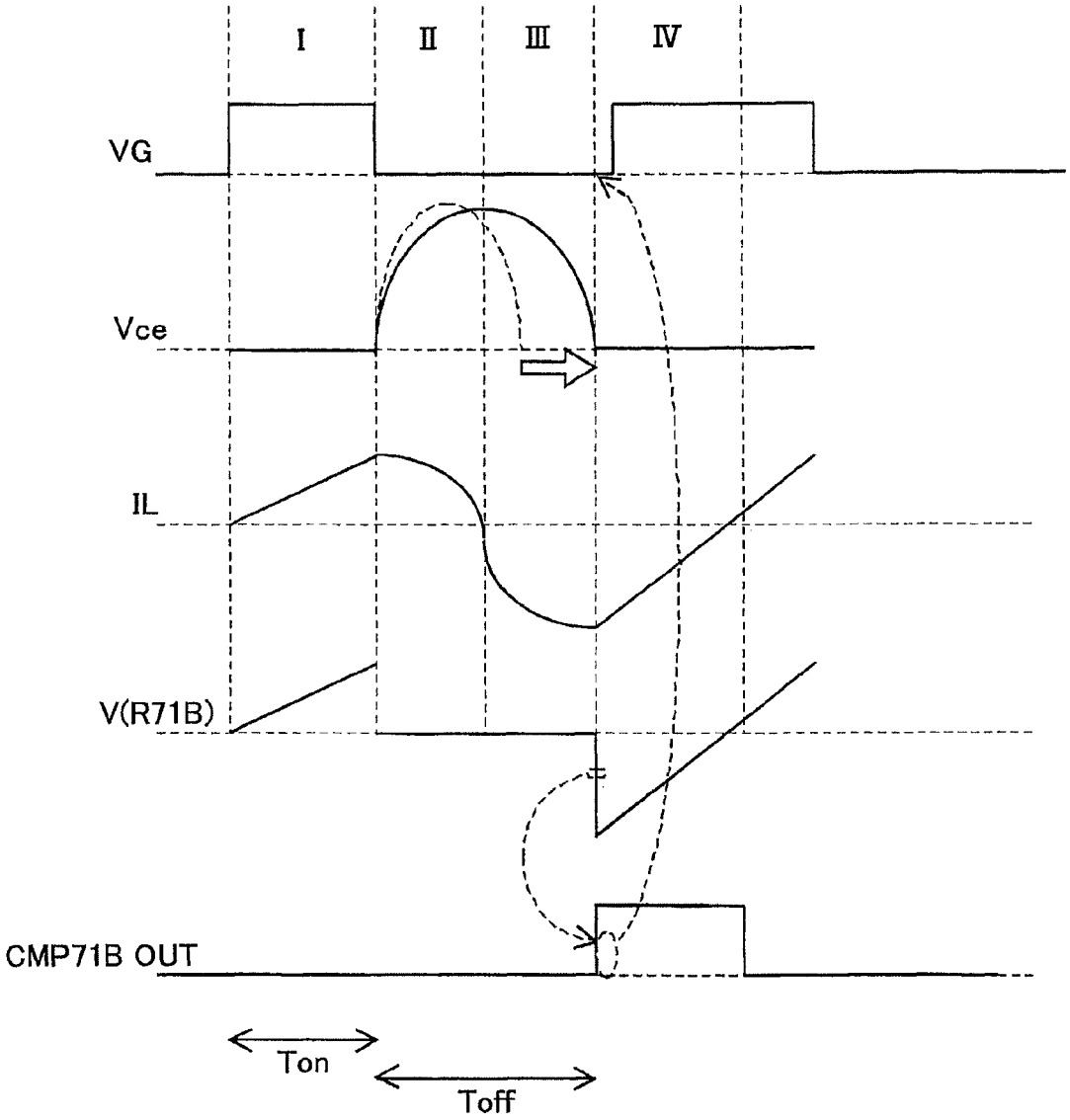
FIG. 14 is a graph illustrating waveforms of the drive voltage of the switching device, the voltage between the collector and the emitter of the switching device, the current flowing through the exciting coil, and an output of the drive current detecting circuit in FIG. 12.

FIG. 13 illustrates a circuit configuration of the drive current detecting circuit 701B. FIG. 14 schematically illustrates the waveforms of the drive voltage of the switching device Q1, the voltage Vice between the collector and the emitter of the switching device Q1, the high-frequency current flowing through the exciting coil 101, and the output voltage of the drive current detecting circuit 701B.

As illustrated in FIG. 13, the drive current detecting circuit 701B includes a resistor R71B and a comparator CMP71B. The resistor R71B is connected between the switching device Q1 and ground (GND). One input terminal (inverting input terminal) of the comparator CMP71B is connected to the junction point of the switching device Q1 and the resistor R71B. The other input terminal (non-inverting input terminal) of the comparator CMP71B is connected to ground (GND). The output of the comparator CMP71B is connected (input) to the control section 207 of the control circuit 204.

In the drive current detecting circuit 701B, the voltage V(R71B) illustrated in FIG. 14 is obtained by measuring the current flowing through the switching device Q1 by performing the current-voltage conversion by the resistor R71B. The voltage V(R71B) is input to the comparator CMP71B. The comparator CMP71B generates its output signal (i.e., the turned-on timing control signal) at the timing when the voltage V(R71B) suddenly decreases (drops) from the zero level. As illustrated in FIG. 14, this timing corresponds to the timing when the voltage Vce between the collector and the emitter of the switching device Q1 becomes zero volts. Namely, substantially, the comparator CMP71B detects the timing when the voltage Vce between the collector and the emitter of the switching device Q1 becomes zero volts.

As described above, according to this embodiment of the present invention, by detecting the timing when the voltage V(R71B) (i.e., the current passing through the switching device Q1) suddenly (steeply) decreases (drops) from the zero level, it may become possible to indirectly or equivalently detect the timing when the voltage Vce between the collector and the emitter of the switching device Q1 becomes zero volts and generate the turned-on timing control signal at the timing. Further, by turning on the switching device Q1 while the voltage Vce between the collector and the emitter of the switching device Q1 is zero volts by changing the level of the drive voltage VG to a high level based on the turned-on timing control signal, it may become possible to promptly respond to the change of the resonance frequency of the LC parallel resonance circuit including the exciting coil 101 and the resonance capacitor Cres, and control the voltage resonance (type) inverter at desired power and temperature while preventing the increase of the energy loss in the switching device Q1 and the damage to the switching device Q1.

According to an embodiment of the present invention, an induction heating device includes a resonance circuit including an exciting coil and a resonance capacitor, the exciting coil applying magnetic flux to a heated body, the resonance capacitor being connected to the exciting coil in parallel; a switching unit that turns on and off a high-frequency current flowing through the switching unit; a temperature detector that detects a temperature of the heated body; a power amount detector that detects a power amount at the exciting coil; a turned-on time setting unit that sets a turned-on time of the switching unit; a timing generation unit that generates a signal indicating a timing when a voltage between both ends of the switching unit is zero; and a timing setting unit that sets a turned-on timing of the switching unit based on the signal generated by the timing generation unit.

According to another embodiment of the present invention, an induction heating fixing device includes the induction heating device described above; a heating roller that is the heated body of the induction heating device; and a fixing/pressing roller disposed opposite to the heating roller.

According to another embodiment of the present invention, an image forming apparatus includes the induction heating fixing device.

According to an embodiment of the present invention, the turned-on time of the switching unit is set so that the temperature of the heated body or the input power amount at the exciting coil is at a desired value, and the turned-on timing of the switching unit is set based on the signal indicating that the voltage between both ends of the switching unit is zero. Because of this feature, it may become possible to perform the zero voltage switching control of the switching unit without being influenced by the change (fluctuation) of the resonance frequency due to the impedance change of the exciting coil and the resonance capacitor caused by the temperature increase of the heated body.

According to embodiments of the present invention, it may become possible to stably operate the induction heating using the voltage resonance (type) inverter, prevent the increase of loss in the switching unit and the damage to the switching unit, and perform faster power control.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. An induction heating device comprising:

a resonance circuit including an exciting coil and a resonance capacitor, the exciting coil applying magnetic flux to a heated body, the resonance capacitor being connected to the exciting coil in parallel;

a switching unit that turns on and off a high-frequency current flowing through the switching unit;

a temperature detector that detects a temperature of the heated body;

a power amount detector that detects a power amount at the exciting coil;

a turned-on time setting unit that sets a turned-on time duration of the switching unit;

a timing generation unit that generates a signal indicating a timing when a voltage between both ends of the switching unit is zero; and a timing setting unit that sets a turned-on timing of the switching unit based on the signal generated by the timing generation unit, and wherein the switching unit remains on for the turned-on time duration set by the turned-on time setting unit, and the switching unit is turned off when the turned-on time duration elapses.

2. The induction heating device according to claim 1, wherein the turned-on time setting unit sets the turned-on time duration of the switching unit so that the temperature detected by the temperature detector is at a desired temperature or the power amount detected by the power amount detector is at a desired power amount.

3. The induction heating device according to claim 1, wherein the timing generation unit includes a voltage detecting unit and a timing detecting unit, wherein the voltage detecting unit is configured to detect the voltage between both ends of the switching unit, and wherein the timing detecting unit is configured to detect a timing when the voltage detected by the voltage detecting unit is zero.

4. The induction heating device according to claim 1, wherein the timing generation unit includes a current detecting unit and a timing detecting unit, wherein the current detecting unit is configured to detect a current flowing through the exciting coil, and wherein the timing detecting unit is configured to detect a timing when a state where the current detected by the current detecting unit changes in a sine waveform transitions to a state where the current linearly changes.

5. The induction heating device according to claim 1, wherein the timing generation unit includes a current detecting unit and a timing detecting unit, wherein the current detecting unit is configured to detect a current flowing through the switching unit, and wherein the timing detecting unit is configured to detect a timing when the current detected by the current detecting unit steeply changes.

6. An induction heating fixing device comprising: the induction heating device according to claim 1; a heating roller that is the heated body of the induction heating device; and a fixing/pressing roller disposed opposite to the heating roller.

7. An image forming apparatus comprising: the induction heating fixing device according to claim 6.

* * * * *